US007544424B2

(12) United States Patent
Gorman et al.

(10) Patent No.: US 7,544,424 B2
(45) Date of Patent: Jun. 9, 2009

(54) NI-BASE SUPERALLOY HAVING A COATING SYSTEM CONTAINING A STABILIZING LAYER

(75) Inventors: Mark Daniel Gorman, West Chester, OH (US); Brian Thomas Hazel, West Chester, OH (US); Brett Allen Rohrer Boutwell, Liberty Township, OH (US); Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 68 days.

(21) Appl. No.: 11/565,410

(22) Filed: Nov. 30, 2006

(65) Prior Publication Data

US 2008/0131720 A1 Jun. 5, 2008

(51) Int. Cl.
*B32B 15/04* (2006.01)

(52) U.S. Cl. ..... 428/652; 428/650; 428/668; 428/670; 428/680; 428/332; 428/336; 416/241 R

(58) Field of Classification Search ..... 428/650, 428/651, 652, 668, 669, 670, 680, 632, 633, 428/215, 332, 336; 416/223 R, 241 R
See application file for complete search history.

(56) References Cited

U.S. PATENT DOCUMENTS

| | | | | |
|---|---|---|---|---|
| 5,334,263 | A | 8/1994 | Schaeffer | |
| 5,427,866 | A | 6/1995 | Nagaraj et al. | |
| 5,598,968 | A | 2/1997 | Schaeffer et al. | |
| 5,891,267 | A | 4/1999 | Schaeffer et al. | |
| 5,942,337 | A | 8/1999 | Rickerby et al. | |
| 6,080,246 | A | 6/2000 | Wing | |
| 6,306,524 | B1 | 10/2001 | Spitsberg et al. | |
| 6,447,932 | B1 | 9/2002 | O'Hara et al. | |
| 6,641,929 | B2 * | 11/2003 | Kelly et al. | 428/632 |
| 6,921,586 | B2 | 7/2005 | Zhao et al. | |
| 6,974,637 | B2 | 12/2005 | Pfaendtner et al. | |
| 2005/0003227 | A1 | 1/2005 | Khan et al. | |
| 2005/0064228 | A1 * | 3/2005 | Darolia et al. | 428/680 |
| 2005/0118334 | A1 | 6/2005 | Gorman et al. | |
| 2006/0040128 | A1 * | 2/2006 | Gorman et al. | 428/650 |

(Continued)

FOREIGN PATENT DOCUMENTS

JP 2000-178763 * 6/2000

*Primary Examiner*—John J. Zimmerman
*Assistant Examiner*—Aaron Austin
(74) *Attorney, Agent, or Firm*—William Scott Andes; Gary M. Hartman; Domenica N. S. Hartman

(57) ABSTRACT

A coating process and system for an article having a substrate formed of a metal alloy that is prone to the formation of a secondary reaction zone (SRZ). The coating system includes an aluminum-containing overlay coating and a stabilizing layer between the overlay coating and the substrate. The overlay coating contains aluminum in an amount greater by atomic percent than the metal alloy of the substrate, such that there is a tendency for aluminum to diffuse from the overlay coating into the substrate. The stabilizing layer is predominantly or entirely formed of at least one platinum group metal (PGM), namely, platinum, rhodium, iridium, and/or palladium. The stabilizing layer is sufficient to inhibit diffusion of aluminum from the overlay coating into the substrate so that the substrate remains essentially free of an SRZ that would be deleterious to the mechanical properties of the alloy.

23 Claims, 2 Drawing Sheets

U.S. PATENT DOCUMENTS

2006/0093752 A1* 5/2006 Darolia et al. ..... 427/523
2006/0121304 A1* 6/2006 Gorman et al. ..... 428/621
2007/0281103 A1 12/2007 Khan

* cited by examiner

NI-BASE SUPERALLOY HAVING A COATING SYSTEM CONTAINING A STABILIZING LAYER

BACKGROUND OF THE INVENTION

The present invention generally relates to protective coating systems for components exposed to high temperatures, such as the hostile thermal environment of a gas turbine engine. More particularly, this invention relates to a coating system that inhibits the formation of deleterious phases in the surface of a superalloy that is prone to coating-induced metallurgical instability.

Certain turbine, combustor and augmentor components of gas turbine engines are susceptible to damage by oxidation and hot corrosion attack, and are therefore protected by an environmental coating and optionally a thermal barrier coating (TBC), in which case the environmental coating is termed a bond coat. In combination, the TBC and bond coat form what has been termed a TBC system.

Environmental coatings and TBC bond coats in wide use include diffusion coatings that contain aluminum intermetallics (predominantly β-phase nickel aluminide (beta-phase NiAl) and platinum aluminides (PtAl)), and overlay coatings such as MCrAlX (where M is iron, cobalt and/or nickel, and X is yttrium, rare earth metals, and/or reactive metals). Other types of environmental coatings and bond coats that have been proposed include beta-phase nickel aluminide (NiAl) overlay coatings. In contrast to the aforementioned MCrAlX overlay coatings, which are metallic solid solutions (such as γ-Ni) containing intermetallic phases (such as beta-phase NiAl), beta-phase NiAl overlay coatings are predominantly the beta-phase NiAl intermetallic compound that exists for nickel-aluminum compositions containing about 30 to about 60 atomic percent aluminum. Examples of beta-phase NiAl overlay coatings are disclosed in commonly-assigned U.S. Pat. No. 5,975,852 to Nagaraj et al., U.S. Pat. No. 6,153,313 to Rigney et al., U.S. Pat. No. 6,255,001 to Darolia, U.S. Pat. No. 6,291,084 to Darolia et al., and U.S. Pat. No. 6,620,524 to Pfaendtner et al. The suitability of environmental coatings and TBC bond coats formed of NiAlPt to contain the gamma-prime phase (γ'-$Ni_3Al$) has also been considered, as disclosed in U.S. patent application Publication Nos. 2004/0229075 to Gleeson et al., 2006/0093801 to Darolia et al., and 2006/0093850 to Darolia et al. Aside from use as additives in MCrAlX overlay coatings, diffusion aluminide coatings, and gamma-prime phase NiAl coatings, platinum and other platinum group metals (PGM's) such as rhodium and palladium have been considered as bond coat materials. For example, commonly-assigned U.S. Pat. No. 5,427,866 to Nagaraj et al. discloses PGM-based diffusion bond coats formed by depositing and diffusing platinum, rhodium, or palladium into a substrate surface, or alternatively diffusing a PGM into an otherwise conventional bond coat material.

TBC systems and environmental coatings are being used in an increasing number of turbine applications (e.g., combustors, augmentors, turbine blades, turbine vanes, etc.). The material systems used for most turbine airfoil applications comprise a nickel-base superalloy as the substrate material, a diffusion platinum aluminide (PtAl) as the bond coat, and a zirconia-based ceramic as the thermally-insulating TBC material. A notable example of a PtAl bond coat composition is disclosed in U.S. Pat. No. 6,066,405 to Schaeffer. Yttria-stabilized zirconia (YSZ), with a typical yttria content in the range of about 3 to about 20 weight percent, is widely used as the ceramic material for TBC's. Improved spallation resistance can be achieved by depositing the TBC by electron-beam physical vapor deposition (EB-PVD) to have a columnar grain structure.

Approaches proposed for further improving the spallation resistance of TBC's are complicated in part by the compositions of the underlying superalloy and interdiffusion that occurs between the superalloy and the bond coat. For example, the above-noted bond coat materials contain relatively high amounts of aluminum relative to the superalloys they protect, while superalloys contain various elements that are not present or are present in relatively small amounts in bond coats. During bond coat deposition, a "primary diffusion zone" of chemical mixing occurs to some degree between the coating and the superalloy substrate as a result of the concentration gradients of the constituents. At elevated temperatures, further interdiffusion occurs as a result of solid-state diffusion across the substrate/coating interface. The migration of elements across this interface alters the chemical composition and microstructure of both the bond coat and the substrate in the vicinity of the interface, causing what may be termed coating-induced metallurgical instability, often with deleterious results. For example, migration of aluminum out of the bond coat reduces its oxidation resistance, while the accumulation of aluminum in the substrate beneath the bond coat can result in the formation of topologically close-packed (TCP) phases that, if present at sufficiently high levels, can drastically reduce the load-carrying capability of the alloy. These detrimental effects occur whether the coating is used as a bond coat for a TBC, or alone as an environmental coating.

Certain high strength superalloys contain significant amounts of refractory elements, such as rhenium, tungsten, tantalum, hafnium, molybdenum, niobium, and zirconium. If present in sufficient amounts or combinations, these elements can reduce the intrinsic oxidation resistance of a superalloy and, following deposition of an aluminum-containing coating, promote the formation of a secondary reaction zone (SRZ) in which deleterious TCP phases form. An example of such a superalloy is commercially known as MX4, a fourth generation single-crystal superalloy disclosed in commonly-assigned U.S. Pat. No. 5,482,789 and exhibiting superior intrinsic strength relative to earlier-generation single-crystal superalloys. Other notable examples of high-refractory superalloys include single-crystal superalloys commercially known under the names René N6 (U.S. Pat. No. 5,455,120), CMSX-10, CMSX-12, and TMS-75, each of which has the potential for being prone to SRZ.

Significant efforts have been put forth to control SRZ in single-crystal superalloys. For example, commonly-assigned U.S. Pat. Nos. 5,334,263, 5,891,267, and 6,447,932 propose direct carburizing or nitriding of a superalloy substrate to form stable carbides or nitrides that tie up the high level of refractory metals present near the surface. Other proposed approaches involve blocking the diffusion path of aluminum into the superalloy substrate with a diffusion barrier coating, examples of which include ruthenium-based coatings disclosed in commonly-assigned U.S. Pat. No. 6,306,524 to Spitsberg et al., U.S. Pat. No. 6,720,088 to Zhao et al., U.S. Pat. No. 6,746,782 to Zhao et al., and U.S. Pat. No. 6,921,586 to Zhao et al. Still other attempts involve coating the surface of a high rhenium superalloy with chromides or cobalt prior to aluminizing the surface, as disclosed in U.S. Pat. No. 6,080,246. Finally, above-noted U.S. Pat. No. 5,427,866 to Nagaraj et al. discloses that a PGM-based coating diffused directly into a superalloy substrate can eliminate the need for a traditional aluminum-containing bond coat and thereby avoid SRZ and TCP phase formation.

Notwithstanding the above, there are ongoing efforts to develop coating systems that substantially reduce or eliminate the formation of SRZ in high-refractory alloys.

BRIEF SUMMARY OF THE INVENTION

The present invention provides a coating process and system for an article comprising a substrate formed of a metal alloy that is prone to the formation of SRZ as a result of containing at least one refractory metal.

The coating system includes an aluminum-containing overlay coating and a stabilizing layer between the overlay coating and the substrate. As such, the coating process generally involves forming the stabilizing layer on the surface of the substrate, and then depositing the aluminum-containing overlay coating on the stabilizing layer. The overlay coating contains aluminum in an amount greater by atomic percent than an amount of aluminum in the metal alloy of the substrate, such that there is a tendency for aluminum to diffuse from the overlay coating into the substrate. The stabilizing layer consists essentially of at least one platinum group metal (PGM), namely, platinum, rhodium, iridium, and/or palladium. The stabilizing layer is sufficient to control diffusion of aluminum from the overlay coating into the substrate and stabilize the substrate, so that the substrate remains essentially free of an SRZ that would be deleterious to the mechanical properties of the alloy.

A significant advantage of this invention is that the stabilizing layer reduces and can even eliminate the formation and growth of SRZ in high-refractory superalloys that are especially prone to SRZ formation. The barrier layer is also potentially effective against the formation of extensive TCP phases. Furthermore, the invention allows for the use of an aluminum-containing overlay coating capable for forming an alumina scale, such that the overlay coating is suitable for use as a bond coat for TBC adherence or as an environmental coating for surfaces not coated by a TBC. The barrier layer of this invention is believed to be capable of maintaining the aluminum reservoir within the overlay coating for oxidation resistance, and improving the performance of bond coat and environmental coating materials that contain relatively low levels of aluminum, including hypostoichiometric beta-phase nickel aluminide intermetallic materials.

Other objects and advantages of this invention will be better appreciated from the following detailed description.

DETAILED DESCRIPTION OF THE INVENTION

Figure 1:
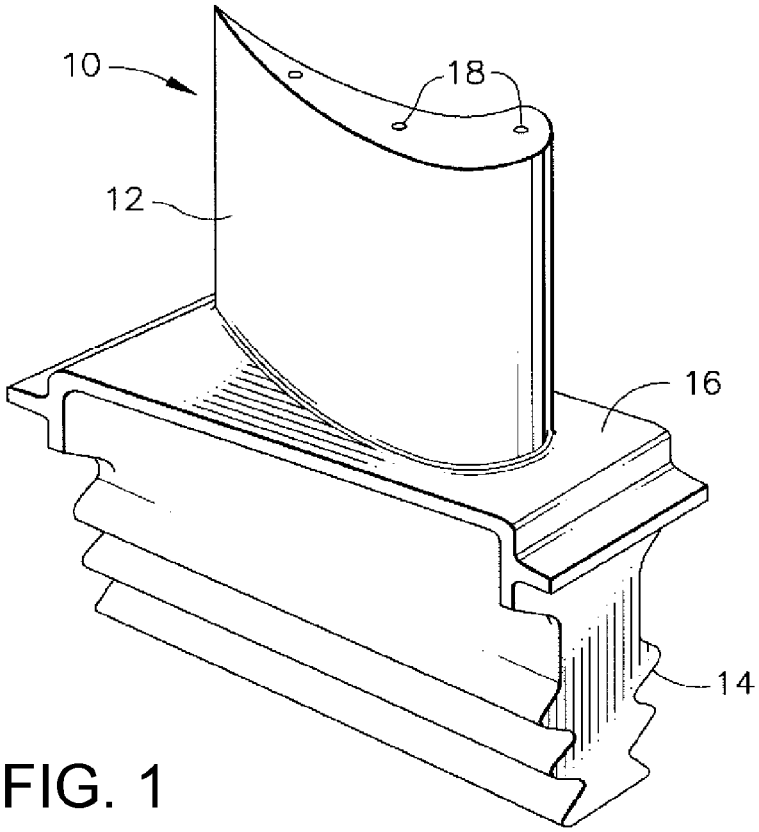
FIG. 1 is a perspective view of a high pressure turbine blade.

The present invention is generally applicable to components that operate within environments characterized by relatively high temperatures, and are therefore likely to be subjected to oxidation, hot corrosion, thermal cycling, and/or thermal stresses. Notable examples of such components include the high and low pressure turbine nozzles and blades, shrouds, combustor liners, and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to severe environmental conditions. The airfoil 12 is anchored to a turbine disk (not shown) with a dovetail 14 formed on a root section 16 of the blade 10. Cooling passages 18 are present in the airfoil 12 through which bleed air is forced to transfer heat from the blade 10. While the advantages of this invention will be described with reference to components of a gas turbine engine, such as the high pressure turbine blade 10 shown in FIG. 1, the teachings of this invention are generally applicable to any component on which a coating system is used to protect a substrate subjected to elevated temperatures, and particularly components formed of metal alloys that are prone to SRZ formation as a result of being protected by a surface coating, such as an aluminum-containing overlay coating.

Figure 2:
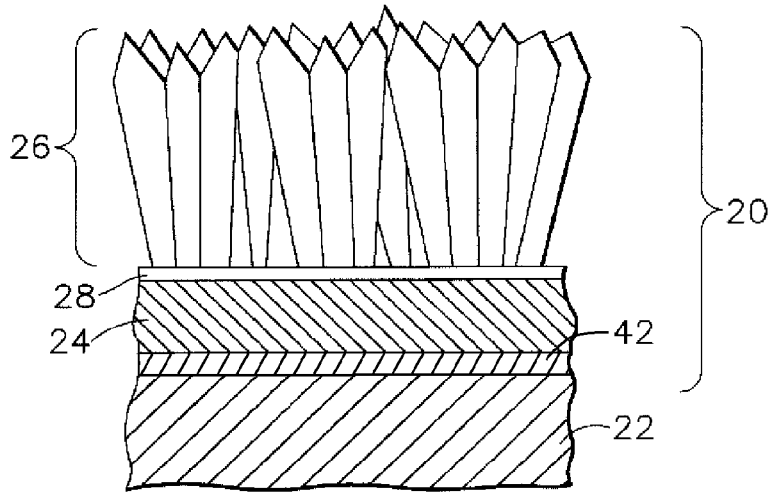
FIG. 2 is a cross-sectional representation of a TBC system on a surface region of the blade of FIG. 1, and depicts a coating system in accordance with an embodiment of this invention.

Represented in FIG. 2 is a surface region of the blade 10 that is protected by a coating system 20 in accordance with an embodiment of the present invention. As shown, the coating system 20 includes a bond coat 24 overlying a superalloy substrate 22, which is typically the base material of the blade 10. The bond coat 24 is shown as adhering an optional thermal-insulating ceramic layer 26, or TBC, to the substrate 22. Suitable materials for the substrate 22 (and therefore the blade 10) include equiaxed, directionally-solidified and single-crystal superalloys, with the invention being especially advantageous for single-crystal nickel-base superalloys that contain at least one refractory metal (e.g., rhenium, tungsten, tantalum, hafnium, molybdenum, niobium, and/or zirconium), for example, rhenium in amounts greater than 4 weight percent. A notable example of such an alloy is the single-crystal nickel-base superalloy known as MX4 disclosed in U.S. Pat. No. 5,482,789. This superalloy nominally contains, by weight, about 0.4% to about 6.5% ruthenium, about 4.5% to about 5.75% rhenium, about 5.8% to about 10.7% tantalum, about 4.25% to about 17.0% cobalt, up to about 0.05% hafnium, up to about 0.06% carbon, up to about 0.01% boron, up to about 0.02% yttrium, about 0.9% to about 2.0% molybdenum, about 1.25% to about 6.0% chromium, up to about 1.0% niobium, about 5.0% to about 6.6% aluminum, up to about 1.0% titanium, about 3.0% to about 7.5% tungsten, a molybdenum+chromium+niobium content of about 2.15% to about 9.0%, an aluminum+titanium+tungsten of about 8.0% to about 15.1%, and the balance nickel and incidental impurities. Another notable example is the high-refractory single-crystal superalloy commercially known under the names René N6 (U.S. Pat. No. 5,455,120), having a nominal composition of, by weight, about 12.5% Co, 4.2% Cr, 7.2% Ta, 5.75% Al, 5.75% W, 5.4% Re, 1.4% Mo, 0.15% Hf, 0.05% C, 0.004% B, 0.01% Y, the balance nickel and incidental impurities. Still other notable examples of high-refractory superalloys include single-crystal superalloys commercially known under the names CMSX-10, CMSX-12, and TMS-75. Each of these alloys is of interest to the present invention as a result of containing refractory metals in amounts sufficient to render them susceptible to forming SRZ.

As is typical with TBC systems for components of gas turbine engines, the bond coat 24 is preferably an aluminum-rich composition. As used herein, an aluminum-rich composition generally denotes a coating that contains a greater amount of aluminum (in atomic percent) than the substrate it protects. Aluminum-rich coating compositions of particular interest to the invention contain about 16 to about 40 weight percent aluminum. Preferred compositions for the bond coat 24 are nickel aluminide intermetallic overlay coatings of predominantly the beta phase (β-NiAl intermetallic), such as greater than 50 volume percent and more typically greater than 80 volume percent beta phase, with the balance mainly the gamma prime phase ($\gamma'$-$Ni_3Al$ intermetallic) and possibly smaller amounts of alpha-Cr and Heusler ($Ni_2AlX$) phases. In addition to nickel and aluminum, nickel aluminide intermetallics suitable for use as the overlay bond coat 24 may also contain additions of chromium, silicon, one or more reactive elements (e.g., yttrium, zirconium, hafnium, and cerium), one or more rare earth metals, and/or one or more refractory metals. Examples of suitable nickel aluminide intermetallic overlay coatings are disclosed in U.S. Pat. Nos. 6,153,313, 6,255,001, 6,291,084, and 6,620,524, which nominally contain, in atomic percent, about 30% to about 60% aluminum (about 16 to about 40 weight percent). Particularly suitable coatings contain about 30 to about 38 atomic percent aluminum (about 16 to about 22 weight percent), optionally up to about 10 atomic percent chromium, optionally about 0.1% to about 1.2% of a reactive element such as zirconium and/or hafnium, optional additions of silicon, and the balance essentially nickel. The bond coat 24 may have a thickness of about 12 to about 75 micrometers, though lesser and greater thicknesses are also possible. The bond coat 24 can be deposited by various overlay processes, such as physical vapor deposition (PVD) processes that include cathodic arc (ion plasma) physical vapor deposition, electron beam-physical vapor deposition (EBPVD), sputtering, and thermal spraying. It is worth noting here that overlay coatings are physically and compositionally distinguishable from diffusion coatings. A diffusion coating significantly interacts with the substrate it protects during deposition as a result of the diffusion process to form various intermetallic and metastable phases beneath the substrate surface, and therefore contains base metal constituents that may be undesirable from the standpoint of providing environmental protection to the substrate. In contrast, an overlay coating does not significantly interact with the substrate it protects during deposition, and as a result predominantly retains its as-deposited composition with a limited diffusion zone.

Aluminum-rich bond coats of the types described above naturally develop an aluminum oxide (alumina) scale 28, which can be more rapidly grown by selective oxidation of the bond coat 24. The ceramic layer 26 is chemically bonded to the bond coat 24 with the oxide scale 28. As shown, the ceramic layer 26 has a strain-tolerant structure with columnar grains produced by depositing the ceramic layer 26 using a physical vapor deposition technique known in the art (e.g., EBPVD), though a plasma spray technique could be used to deposit a noncolumnar ceramic layer. A preferred material for the ceramic layer 26 is an yttria-stabilized zirconia (YSZ), a preferred composition being about 6 to about 8 weight percent yttria, optionally with up to about 60 weight percent of an oxide of a lanthanide-series element to reduce thermal conductivity. Other ceramic materials could be used for the ceramic layer 26, such as yttria, nonstabilized zirconia, or zirconia stabilized by magnesia, ceria, scandia, and/or other oxides. The ceramic layer 26 is deposited to a thickness that is sufficient to provide the required thermal protection for the underlying substrate 22 and blade 10, generally on the order of about 75 to about 300 micrometers, though lesser and greater thicknesses are also possible. While described in reference to a coating system 20 that includes a ceramic layer (TBC) 26, the present invention is also applicable to coating systems that exclude a ceramic coating, in which case the bond coat 24 is the outermost layer of the coating system 20 and may be termed an environmental coating. However, for convenience the layer identified by reference number 24 in FIG. 2 will be referred to as a bond coat 24 in the following discussion.

Figure 3:
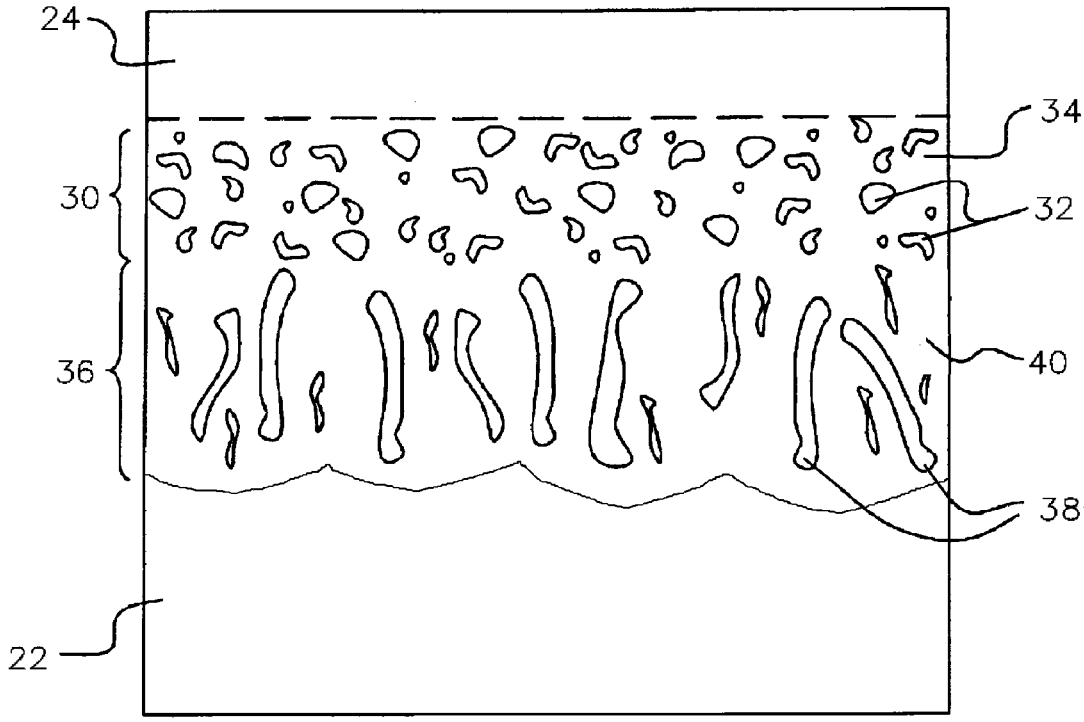
FIG. 3 (Prior Art)
FIG. 3 represents a cross-sectional view through a surface region of a substrate on which an aluminum-containing coating has been deposited, and in which a secondary reaction zone (SRZ) has formed as a result of interdiffusion between the substrate and coating.

As discussed previously, when deposited an overlay coating such as the bond coat 24 of FIG. 2 forms a limited diffusion zone as a result of chemical mixing between the bond coat 24 and the superalloy substrate 22. As represented in FIG. 3 (in which the ceramic layer 26 and oxide scale 28 are omitted), a primary diffusion zone 30 may form in the substrate 22 beneath the bond coat 24 during high temperature exposures. The primary diffusion zone 30 is represented as containing topologically close-packed (TCP) phases 32 in the gamma matrix phase 34 of the nickel-base superalloy substrate 22. The incidence of a moderate amount of TCP phases 32 beneath the bond coat 24 is typically not detrimental. However, at elevated temperatures, further interdiffusion can occur as a result of solid-state diffusion across the substrate/coating interface. This additional migration of elements across the substrate-coating interface can sufficiently alter the chemical composition and microstructure of both the bond coat 24 and the substrate 22 in the vicinity of the interface to have deleterious results. For example, migration of aluminum out of the bond coat 24 reduces its oxidation resistance, while the accumulation of aluminum in the substrate 22 beneath the bond coat 24 can result in the formation of a deleterious SRZ 36 beneath the primary diffusion zone 30. The above-noted nickel-base superalloys said to be prone to the SRZ formation are particularly prone to developing an SRZ 36 that contains plate-shaped and needle-shaped precipitate phases 38 (such as P, sigma, and mu phases and TCP phases of chromium, rhenium, tungsten and/or tantalum) in a gamma-prime matrix phase 40 (characterized by a gamma/gamma-prime inversion relative to the substrate 22). Because the boundary between SRZ constituents and the original substrate 22 is a high angle boundary and doesn't resist deformation, the SRZ 36 and its boundaries readily deform under stress, with the effect that rupture strength, ductility and fatigue resistance of the alloy are reduced.

According to this invention, the bond coat 24 in FIG. 2 is shown as being separated from the substrate 22 by a stabilizing layer 42, which is preferably deposited directly on the surface of the substrate 22. To be effective, the stabilizing layer 42 must control the interdiffusion of constituents between the substrate 22 and bond coat 24, such as aluminum that tends to diffuse into the superalloy substrate 22 from the bond coat 24 and elements whose diffusion can lead to TCP formation. In so doing, the stabilizing layer 42 inhibits the formation in the substrate 22 of SRZ and the deleterious TCP phases discussed above in reference to FIG. 3.

The predominant constituent of the stabilizing layer 42 is one or more platinum group metals (PGM's), more particularly platinum, rhodium, iridium, and/or palladium, and is therefore termed a PGM-based metallic material. More preferably, the stabilizing layer 42 is formed entirely of platinum, rhodium, iridium, and/or palladium, along with incidental impurities and elements inevitably present as a result of even limited interdiffusion with the bond coat 24 and the substrate 22. In atomic percent, the stabilizing layer 42 contains a combined amount of at least about 75% platinum group metal (s), and more preferably at least 90% platinum group metal (s). Optionally, the stabilizing layer 42 could be alloyed to contain intentional additions of nickel, cobalt, chromium, aluminum, and ruthenium in a combined amount of up to about 25 atomic percent. The stabilizing layer 42 can be formed by applying a layer of the platinum group metal or metals to the surface of the substrate 22, without performing a processing step to intentionally diffuse the layer into the substrate 22. For example, the platinum group metal or metals can be plated onto the surface of the substrate 22, followed by an optional heat treatment at a temperature of about 1650 to about 2050° F. (about 900 to about 1120° C.) for about one to eight hours to remove hydrogen from the plated deposit and improve adhesion. The stabilizing layer 42 is preferably deposited before the bond coat 24 is deposited, and has a preferred final thickness of at least about three micrometers, more preferably about four to about twelve micrometers.

While not wishing to be held to any particular theory, the PGM stabilizing layer 42, as a result of being located between the SRZ-prone superalloy substrate 22 and the bond coat 24 with a higher aluminum content than the substrate 22, is believed to lower the activity of aluminum and be capable of promoting "uphill" diffusion of aluminum from the substrate 22 into the stabilizing layer 42. As such, the stabilizing layer 42 promotes the formation and subsequently helps to sustain a higher aluminum level region in contact with the substrate 22, while stabilizing the substrate against TCP formation. Furthermore, the aluminum contents in the substrate 22 and bond coat 24 remain relatively stable when the substrate 22 is subjected to high temperatures that would be otherwise sufficient to cause significant diffusion of aluminum from the bond coat 24 into the substrate 22 and lead to SRZ formation. Again, though not wishing to be held to any particular theory, the PGM stabilizing layer 42 is believed to reduce diffusion by reducing the activity of aluminum, in contrast to reducing diffusivity as is done with the use of a refractory element diffusion barrier layer.

In an investigation leading to the present invention, coatings in accordance with the foregoing discussion were deposited on SRZ-prone superalloy specimens and subsequently subjected to an extended high temperature exposure. The specimens were single-crystal castings formed of René N6 superalloy in the solutioned and primary aged condition. Some of the specimens were designated as experimental and provided with a stabilizing layer by plating an eight-micrometer thick layer of platinum on their surfaces, followed by a two-hour vacuum heat treatment at about 1700° F. (about 930° C.). The experimental specimens and the remaining baseline specimens were then coated with beta-phase NiAl intermetallic overlay coatings deposited by ion plasma deposition to a thickness of about thirty micrometers. The overlay coatings had the following nominal composition (in weight percent): about 18% aluminum, about 6% chromium, about 1% zirconium, and the balance nickel and incidental impurities. Finally, all specimens underwent a four-hour heat treatment at about 1975° F. (about 1080° C.).

Figure 4:
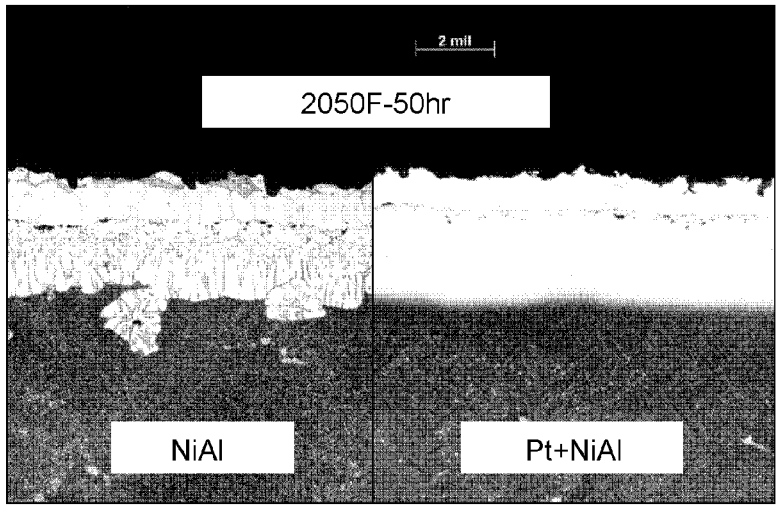
FIG. 4 shows scanned cross-sectional images of two specimens of René N6 superalloy following an extended high temperature exposure, in which both specimens are protected with a beta-phase NiAl intermetallic environmental coating, but only the righthand specimen is further protected by a PGM stabilizing layer in accordance with an embodiment of this invention.

The baseline and experimental specimens were then exposed at about 2050° F. (about 1120° C.) for about 50 hours to an air environment to assess the tendency for SRZ formation. Following this exposure, the specimens were sectioned and polished for metallographic viewing. The lefthand scanned image of FIG. 4 is a cross-sectional view of the near-surface region of a specimen protected only by an overlay coating, while the righthand scanned image of FIG. 4 is an equivalent image of a specimen protected by the combined overlay coating and stabilizing layer. The tested specimens evidenced that both coating systems were able to protect the underlying N6 substrate from oxidation. FIG. 4 further shows that, while diffusion zones of approximately equal thicknesses formed in both specimens, the baseline specimen seen in FIG. 4 formed an extensive SRZ zone, whereas essentially no SRZ is visible in the substrate of the coupon protected with the coating system of this invention (overlay coating+stabilizing layer). Furthermore, the linear coverage of SRZ in the baseline specimen is about 100%. As such, the test demonstrated the ability of a coating system of this invention to prevent or at least significantly reduce the formation of SRZ in the René N6 superalloy and provide environmental oxidation protection, while not visibly or otherwise significantly affecting diffusion.

While the invention has been described in terms of particular embodiments, it is apparent that other forms could be adopted by one skilled in the art. Therefore, the scope of the invention is to be limited only by the following claims.

The invention claimed is:

1. An article comprising a substrate and a coating system on a surface of the substrate, the substrate being formed of a nickel-base alloy containing at least one refractory metal in an amount sufficient to render the substrate susceptible to a gamma/gamma-prime inversion and susceptible to forming a secondary reaction zone (SRZ) in which deleterious topologically close-packed (TCP) phases form, the coating system consisting of an aluminum-containing overlay coating and a stabilizing layer between the overlay coating and the substrate, the overlay coating containing aluminum in an amount greater by atomic percent than an amount of aluminum in the metal alloy of the substrate, the stabilizing layer consisting essentially of at least one platinum group metal chosen from the group consisting of platinum, rhodium, iridium, and palladium, wherein neither the aluminum-containing overlay coating and the stabilizing layer has undergone a diffusion treatment to diffuse the stabilizing layer and the aluminum-containing overlay coating into the substrate, and the substrate is essentially free of an SRZ that is deleterious to the mechanical properties of the metal alloy of the substrate.

2. The article according to claim 1, wherein the overlay coating is a nickel aluminide intermetallic overlay coating of predominantly the beta phase.

3. The article according to claim 2, wherein the overlay coating contains greater than 80 volume percent beta phase, with the balance mainly the gamma prime phase.

4. The article according to claim 2, wherein the overlay coating contains at least one of chromium, silicon, reactive elements, rare earth metals, and refractory metals.

5. The article according to claim 1, wherein the overlay coating consists essentially of a beta-phase nickel aluminide intermetallic consisting of about 30 to about 60 atomic percent aluminum, optionally one or more elements chosen from the group consisting of chromium, zirconium, hafnium, yttrium, and silicon, and the balance nickel and incidental impurities.

6. The article according to claim 1, further comprising a ceramic coating on the overlay coating.

7. The article according to claim 1, wherein the at least one refractory metal comprises rhenium in an amount greater than 4weight percent.

8. The article according to claim 1, wherein the stabilizing layer consists of at least 75 atomic percent of the at least one platinum group metal, optionally nickel, cobalt, chromium, aluminum, and/or ruthenium in a combined amount of up to about 25 atomic percent, elements present in the stabilizing layer as a result of diffusion from the substrate and diffusion from the overlay coating, and incidental impurities.

9. The article according to claim 8, wherein the amount of the at least one platinum group metal in the stabilizing layer is at least 90 atomic percent.

10. The article according to claim 8, wherein the at least one platinum group metal consists of platinum.

11. The article according to claim 1, wherein the stabilizing layer has a thickness of about 3 to about 12 micrometers.

12. The article according to claim 1, wherein the article is a gas turbine engine component.

13. An article comprising a substrate and a coating system on a surface of the substrate, the substrate being formed of a nickel-base alloy containing at least one refractory metal in an amount sufficient to render the substrate susceptible to a gamma/gamma-prime inversion and susceptible to forming a secondary reaction zone (SRZ) in which deleterious topologically close-packed (TCP) phases form, the coating system comprising an aluminum-containing overlay coating and a stabilizing layer between the overlay coating and the substrate, the overlay coating containing aluminum in an amount greater by atomic percent than an amount of aluminum in the metal alloy of the substrate, the stabilizing layer consisting essentially of at least one platinum group metal chosen from the group consisting of platinum, rhodium, iridium, and palladium, wherein the overlay coating is a nickel aluminide intermetallic overlay coating of predominantly the beta phase.

14. The article according to claim 13, wherein the overlay coating contains greater than 80 volume percent beta phase, with the balance mainly the gamma prime phase.

15. The article according to claim 13, wherein the overlay coating contains at least one of chromium, silicon, reactive elements, rare earth metals, and refractory metals.

16. The article according to claim 13, wherein the overlay coating consists essentially of the beta-phase consisting of about 30 to about 60 atomic percent aluminum, optionally one or more elements chosen from the group consisting of chromium, zirconium, hafnium, yttrium, and silicon, and the balance nickel and incidental impurities.

17. The article according to claim 13, further comprising a ceramic coating on the overlay coating.

18. The article according to claim 13, wherein the at least one refractory metal comprises rhenium in an amount greater than 4 weight percent.

19. The article according to claim 13, wherein the stabilizing layer consists of at least 75 atomic percent of the at least one platinum group metal, optionally nickel, cobalt, chromium, aluminum, and/or ruthenium in a combined amount of up to about 25 atomic percent, elements present in the stabilizing layer as a result of diffusion from the substrate and diffusion from the overlay coating, and incidental impurities.

20. The article according to claim 19, wherein the amount of the at least one platinum group metal in the stabilizing layer is at least 90 atomic percent.

21. The article according to claim 19, wherein the at least one platinum group metal consists of platinum.

22. The article according to claim 13, wherein the stabilizing layer has a thickness of about 3 to about 12 micrometers.

23. The article according to claim 13, wherein the article is a gas turbine engine component.

* * * * *